US005429496A

United States Patent [19]

Stephens et al.

[11] Patent Number: 5,429,496

[45] Date of Patent: Jul. 4, 1995

[54] PORTABLE FLARE BOOM CAPABLE OF BEING EASILY RAISED AND LOWERED TO CHANGE THE FLARING ASSEMBLY

[75] Inventors: Darrell A. Stephens, Corpus Christi; Bobby R. Duke, Midland, both of Tex.

[73] Assignee: National Tank Company, Houston, Tex.

[21] Appl. No.: 94,529

[22] Filed: Jul. 20, 1993

[51] Int. Cl.[6] ..... F23D 14/00

[52] U.S. Cl. ..... 431/202; 431/279

[58] Field of Search ..... 431/202, 264, 278, 286, 431/350, 353, 192, 279; 239/273, 587.2

[56] References Cited

U.S. PATENT DOCUMENTS

| | | | |
|---|---|---|---|
| 2,240,508 | 5/1941 | Lewis | 67/3 |
| 2,480,230 | 8/1949 | Elster | 158/115 |
| 2,661,798 | 12/1953 | Clevenger et al. | 158/115 |
| 2,802,521 | 8/1957 | Campbell et al. | 431/202 |
| 2,830,658 | 4/1958 | Smith | 158/115 |
| 3,247,885 | 4/1966 | Reed | 158/99 |
| 3,666,395 | 5/1972 | Kubasta | 431/202 |
| 3,756,765 | 9/1973 | Sparrow et al. | 431/202 |
| 3,810,733 | 5/1974 | Reagan | 431/202 |
| 3,880,573 | 4/1975 | Simmons | 431/202 |
| 3,914,094 | 10/1975 | Landry | 431/202 |
| 3,932,111 | 1/1976 | Liknes et al. | 431/202 |
| 3,982,881 | 9/1976 | Schwartz et al. | 431/202 |
| 3,994,671 | 11/1976 | Straitz, III | 431/202 |
| 4,090,840 | 5/1978 | Straitz, III | 431/14 |
| 4,101,257 | 7/1978 | Straitz, III | 431/15 |
| 4,255,120 | 3/1981 | Straitz, III | 431/202 |
| 4,269,583 | 5/1981 | Straitz, III | 431/202 |
| 4,325,690 | 4/1982 | Hayes | 431/78 |
| 4,392,816 | 7/1983 | Berlie et al. | 431/202 |
| 4,406,615 | 9/1983 | Guerra et al. | 431/278 |
| 4,559,006 | 12/1985 | McGill et al. | 431/3 |
| 4,741,691 | 5/1988 | Messimer | 431/202 |
| 4,826,427 | 5/1989 | Hyde | 431/202 |
| 4,952,137 | 8/1990 | Schwartz et al. | 431/202 |
| 5,291,367 | 3/1994 | Rajewski | 431/202 |

*Primary Examiner*—James C. Yeung
*Attorney, Agent, or Firm*—Head & Johnson

[57] ABSTRACT

A portable flare boom for the combustion of waste gases is disclosed for easy installation and maintenance requiring limited labor to adjust and install the flare boom. Preferably, the portable flare boom is for locations close to tank batteries or oil wells for the incineration of waste gas which is often vented into the atmosphere. It has a unitary vertical support frame perpendicular to a base plate and a hinge pin located on the vertical support frame for raising and lowering a flare stack pipe. On the upper end of the flare stack pipe is located a flaring assembly.

8 Claims, 4 Drawing Sheets

22
90
20
24
28
30
14
12
26
19
18
86
10
16
88

PORTABLE FLARE BOOM CAPABLE OF BEING EASILY RAISED AND LOWERED TO CHANGE THE FLARING ASSEMBLY

BACKGROUND OF THE INVENTION

1. Field of the Invention

This invention pertains to portable flare booms having a gas burner in which the flare boom can be easily lowered to change out various components of the flaring assembly.

2. Background

Waste gas burners or flaring devices are used extensively throughout the petroleum and chemical industries to burn combustible waste gases which would otherwise be vented into the atmosphere as unburned hydrocarbons. Often, the venting of waste gases produces serious safety hazards resulting from a vapor cloud explosion as well as having a severe adverse environmental impact since many of the waste hydrocarbons adversely affect the atmosphere more than carbon dioxide.

In many instances, flaring assemblies are installed which require an expensive and permanent installation of the flaring assembly. Often the permanent installations do not satisfy the requirements of a portable flaring system which could be used in lieu of or prior to completion of a permanent installation. Also, infrequent use of the flaring device does not justify a permanent installation. One solution was proposed by Straitz, III in U.S. Pat. No. 4,255,120.

SUMMARY OF THE INVENTION

In accordance with the invention, a portable flare boom capable of being easily raised and lowered to change out components of the flaring assembly is provided for the combustion of waste gases. These waste gases are often the product or at least a byproduct from the production of hydrocarbons, the storage of hydrocarbons or from the production of chemicals or other waste products from oil refineries and the like. This invention includes a base having a vertical support frame with a capability of mechanically raising and lowering a plurality of flare stack pipe segments. In the preferred embodiment, a flare stack pipe is pivotally attached to a unitary vertical support structure having a base and vertical members securing a pivot pin for the rotation of the flare stack pipe.

Attached to the upper portion of the top flare stack pipe segment is a flaring assembly. The flaring assembly has a removably supported wind shield shielding the flare from high winds. Stabilized and supported within the wind shield is the flare nozzle and a means for allowing the mixture of air to the waste gas stream prior to burning. A pilot light is provided near the flare nozzle to maintain continuous burning during flaring operations.

It is the principal object of the invention to provide a portable flare boom capable of being easily raised and lowered to change components of the flaring assembly to suit burning operations.

It is the further object of the invention to provide a portable flare boom having protective features to minimize the hazards during flaring operations and also to provide for a minimal requirement of labor to install and operate. It is the further object of the invention to provide for the burning of highly corrosive gases. Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings, in which.

DETAILED DESCRIPTION OF THE PREFERRED EMBODIMENT

Figure 1:
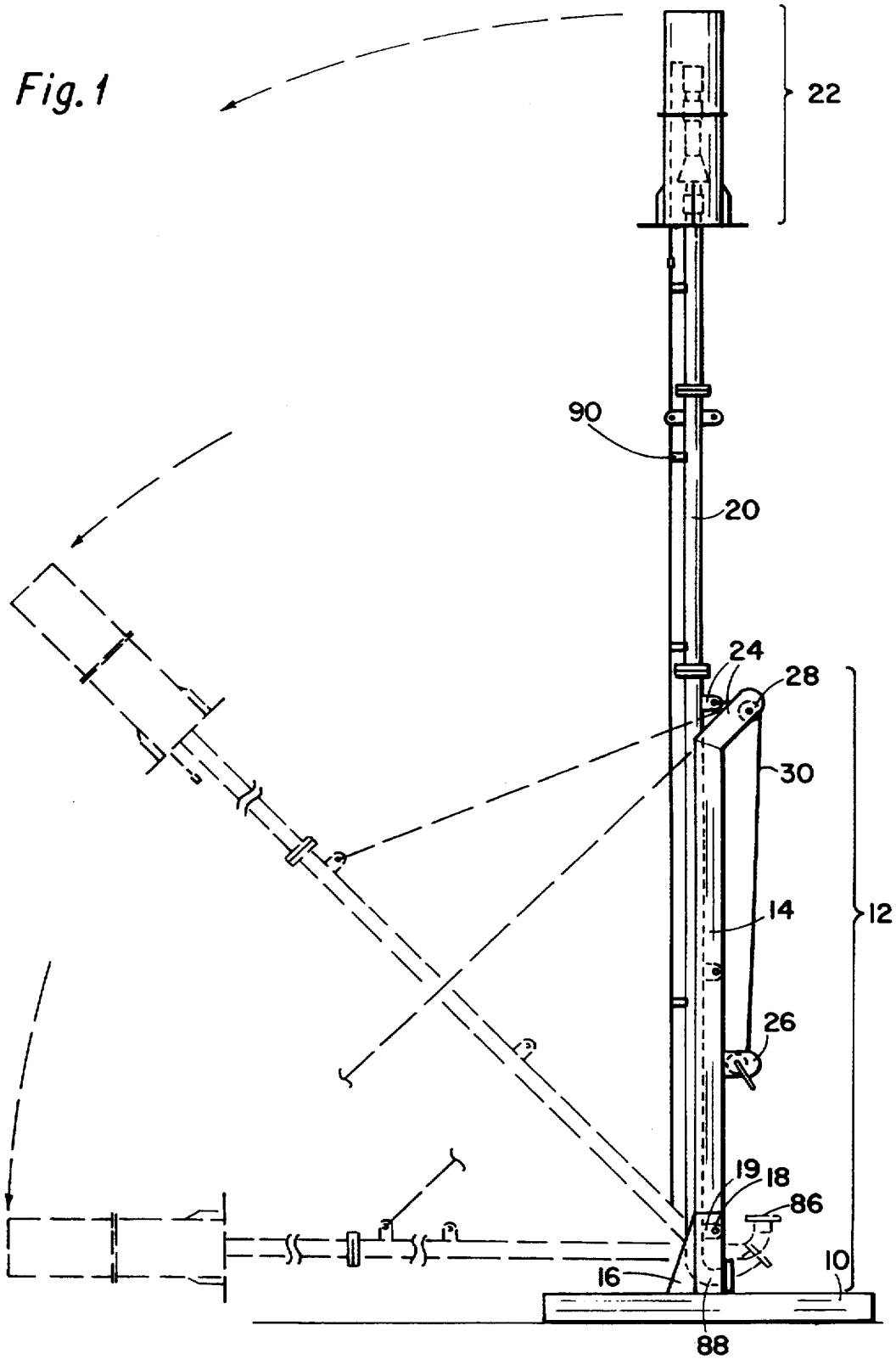
FIG. 1 is a side elevational view of the flare boom illustrating its raising and lowering capabilities.

Referring to FIG. 1, illustrated is a portable flare boom used to incinerate waste gas, typically that waste gas that is generated during the production of liquid hydrocarbons, at oil field tank batteries, and during refining operations. Currently, in many areas, the waste gas produced is vented into the atmosphere. Environmental, as well as safety concerns make it desirable to incinerate the waste gas.

The portable flare boom has a base stand 10 which is positioned on level ground. Base stand 10 is typically 1.85 meters (6 feet) by 1.23 meters (4 feet). A vertical support frame 12 is rigidly attached perpendicular to base stand 10 at about its center. Vertical support frame 12 is typically about 3.38 meters (11 feet) in height and has left and right vertical frame members 14. A reinforcing member 16, attached to each left and right vertical frame members 14, provides additional strength and stability between the vertical frame members 14 and the base stand 10 providing a unitary structure. The top portion of left and right vertical frame members 14 are angled in the opposite direction or side of frame 12 from which the flare boom will be lowered. A hinge pin 18 attached to frame member 14 near its lower end, provides a pivot point for the raising and lowering of the flare boom. A hinge shoulder 19 is attached to the lower portion of flare stack pipe 20 and has a hole which receives hinge pin 18.

The flare boom itself comprises the base and vertical frame structure previously described, at least one flare stack pipe 20 and a flaring assembly 22. When positioned in the upright position, the flare stack pipe 20 attached at hinge pin 18, angles at an elbow 88 so that the flare stack pipe 20 can receive the waste gas supplying line 23 leading from the production field, tank battery, or refinery. On the upper portion of this same flare stack pipe 20, is located an eyelet 24. Typically, located one to two meters above base stand 10 and attached to left and right vertical frame members 14 is a hand winch 26, preferably a manual two speed hoist with a hand brake. Located between the upper portions of left and right vertical frame members 14 is a single pulley 28. A cable 30 is attached at one end to the eyelet 24 and extends over pulley 28 and is wrapped around a drum which is part of the hand winch 26. The hand winch 26 and pulley 28 act as the means for raising and lowering the flare boom.

If additional height of the flaring assembly 22 is required, additional flare stack pipe segments 33 can be added to provide the proper elevation. Preferably the height should be approximately eight meters from the base 10 to the top of the flaring assembly 22. For easier raising and lowering of a flare boom having multiple flare stack pipe segments 33, a motorized winch system can be utilized.

Figure 2:
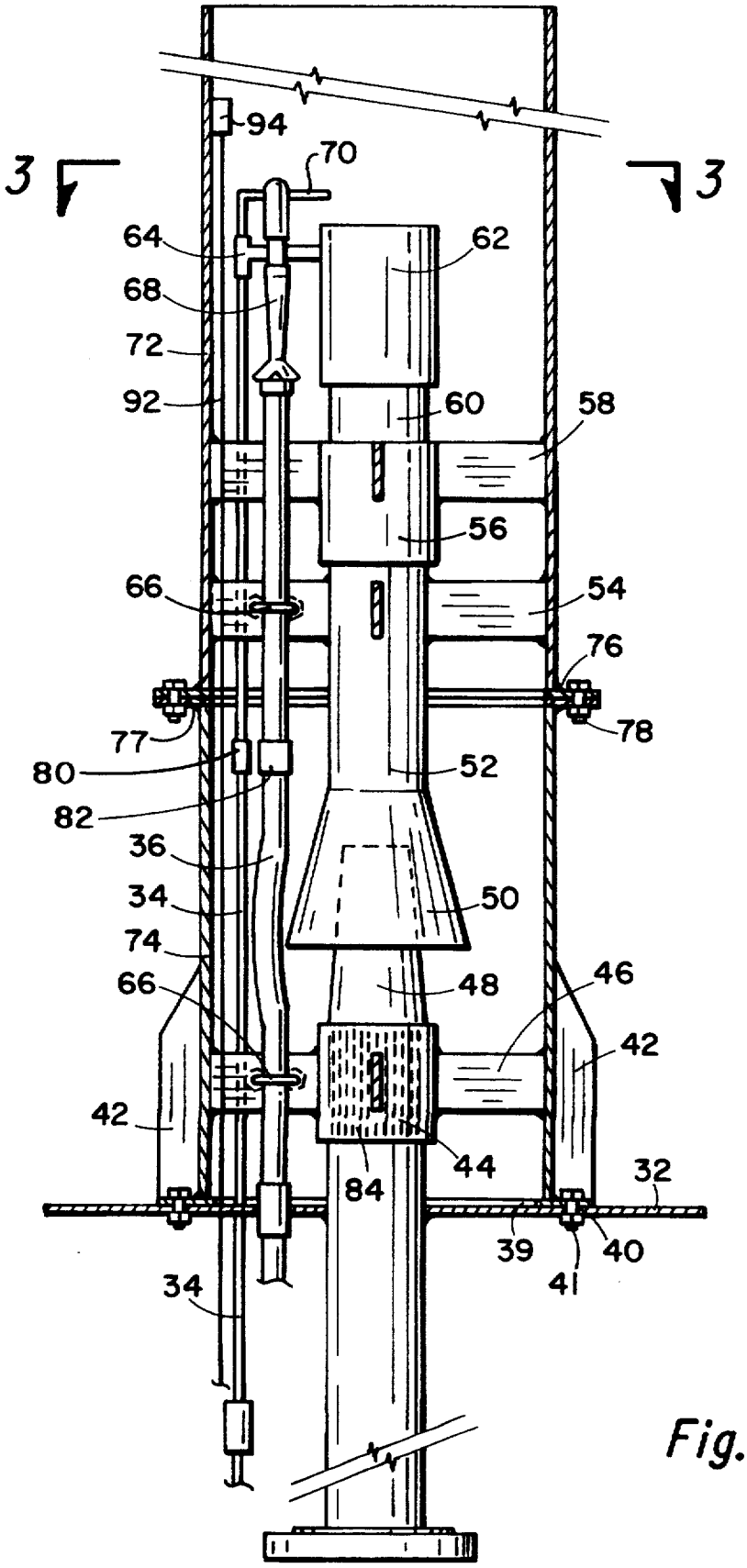
FIG. 2 is a cross-sectional view of the flaring assembly.
Figure 3:
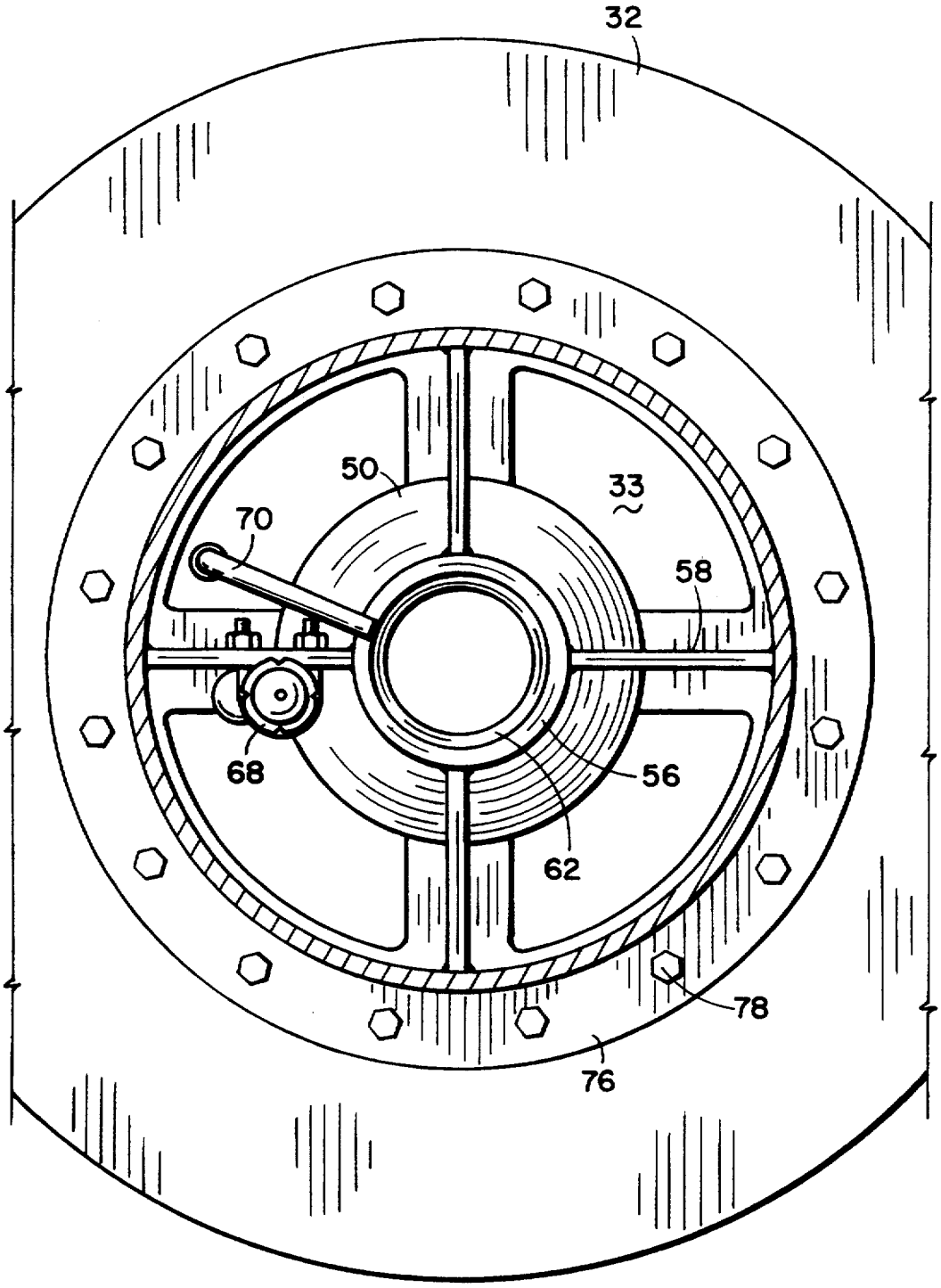
FIG. 3 is a cross-sectional view of the flaring assembly taken along the line 3—3 of FIG. 2.
Figure 4:
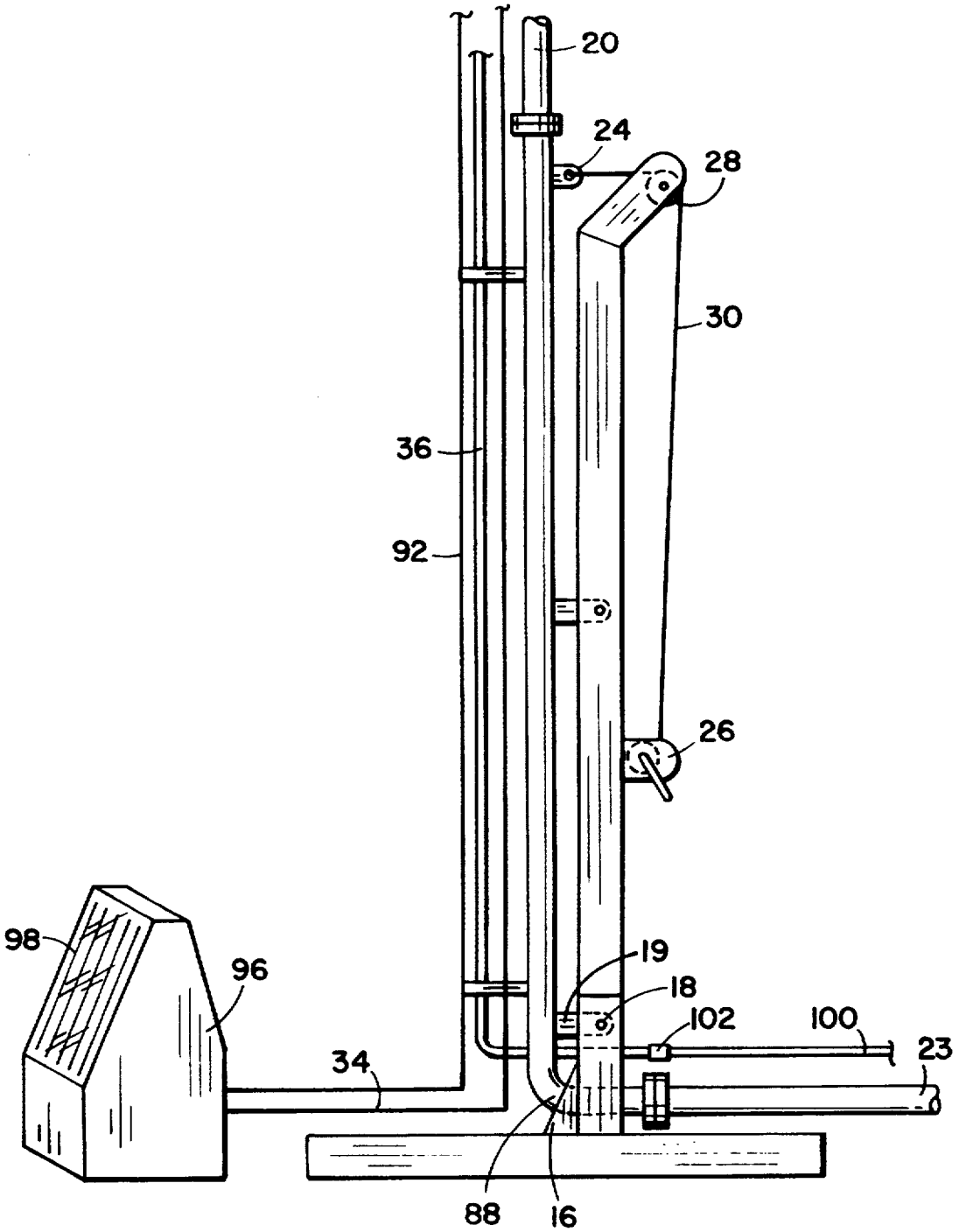
FIG. 4 is a side elevational view of the unitary structure of the base plate and vertical support members illustrating the connections of the waste gas pipe, inlet pilot gas line and the igniter rod with a solar powered panel.

FIGS. 2 and 3 illustrate the flaring assembly 22. The upper portion of flare stack pipe 20 extends through a base plate 32. Also extending through the base plate 32 are an igniter rod 34, an inlet pilot gas pipe 36, and a signal linkage 92 between a means for detecting a flame 94 and the remote panel 96. The means for flame detection 94 is preferably located in the upper section of the wind shield 72 near the flame nozzle 62 and typically is an ultra-violet light or heat detector. The remote panel 96 can be powered by a solar panel 98 should the flare boom be located in a remote area where electricity is inaccessible.

A plurality of air inlet openings 33 are located on the base plate 32 which allow air to flow into the interior of the upper and lower sections of the wind shield 72 and 74. The igniter rod 34 and the inlet pilot gas pipe 36 extend downward to the base stand 10 and are attached to the side of the flare stack pipe 20 by mounting brackets 90.

During the raising and lowering of the flare boom, the inlet pilot gas pipe 36 can be disconnected from the pilot gas supply line 100 at coupling 102. Likewise, the igniter rod 34 and the signal linkage 92 can be disconnected to facilitate raising and lowering of the flare boom.

The upper and lower sections of the wind shield 72 and 74 are preferably a hollow steel cylinder encompassing the igniter rod 34, the inlet pilot gas pipe 36, the flare stack pipe 20, and other internal components making up the flaring assembly 22. Spaced apart gussets 42 are located around the lower, exterior portion of the lower section of the wind shield 74 and preferably welded to the lower section of the wind shield 74 and a lower wind shield flange 39. The lower wind shield flange 39 has a plurality of evenly spaced holes 40 which can be aligned with mating holes in the base plate 32 for bolts 41 to secure and stabilize the upper and lower sections of the wind shield 72 and 74 to the base plate 32.

The flare stack pipe 20 extends upward to a coupling 44. Coupling 44 is stabilized within the upper and lower sections of the wind shield 72 and 74 by a first series of reinforcing stabilizers 46. Reinforcing stabilizers 46 provide further stability of the internal components with respect to the upper and lower sections of the wind shield 72 and 74. Attached to the upper portion of coupling 44 is a concentric reducer 48. Preferably, the concentric reducer 48 reduces the diameter of the flare stack pipe 20. A hood 50, located slightly above and spaced from the concentric reducer 48 such that air can be mixed with the waste gas stream introduced through the concentric reducer 48. The reduced diameter size of the concentric reducer 48 controls the velocity of the waste gas exiting the flaring assembly 22. The waste gas velocity also influences the quantity of air being mixed with the waste gas in the hood 50.

An extension pipe 52 is attached to the upper side of the hood 50. A second set of reinforcing stabilizers 54 stabilizes the hood 50 within the upper and lower sections of the wind shield 72 and 74. Removably attached to the upper end of extension pipe 52 is a second coupling 56 which is stabilized within the upper and lower sections of the wind shield 72 and 74 by a third set of reinforcing stabilizers 58. A nipple 60 connects the second coupling 56 with the flare nozzle 62.

Igniter rod 34 extends through base plate 32 and is stabilized and secured to the flare nozzle 62 by igniter rod stabilizer 64. The inlet pilot gas pipe 36 also extends through base plate 32 and is secured and stabilized within the upper and lower sections of the wind shield 72 and 74 by U-bolts 66 mounted on the first and second sets of reinforcing stabilizers 46 and 54. Attached to the end of the inlet pilot gas pipe 36 is a fuel air mixer 68. A pilot nozzle 70 is attached to the upper portion of the fuel air mixer 68. Both the top of the pilot nozzle 70 and the end of the igniter rod 34 are located slightly above the top of the flare nozzle 62. Both the igniter rod 34 and the inlet pilot gas pipe 36 are preferably made from stainless steel to resist corrosion.

Typically, the upper and lower sections of the wind shield 72 and 74 can be easily separated. The bottom of the lower section of the wind shield 74 is secured to a base plate 32 and has previously been described. The upper end of the lower section of the wind shield 74 and the lower end of the upper section of the wind shield 72 have a circular flange 76 welded to both sections of the wind shield. A plurality of wind shield bolts 78 secure the two circular flanges 76 together. Upon lowering of the flaring assembly 22 and disassembly of the wind shield bolts 78, the upper and lower sections of the wind shield can be disassembled. Couplings 80 and 82 allow for the separation of the igniter rod 34 and the inlet pilot gas pipe 36. Once separated, the concentric reducer 48 can be changed. The concentric reducer is preferably 15 centimeter in length and its diameter can range from approximately 1.27 centimeters (½") to 7.62 centimeters (3 inches). It is preferable to change out the concentric reducer 48 in order to achieve the optimum air/waste gas mixture to ensure a clean burn.

For operations in a sour gas environment, or when the waste gas is highly corrosive, all components in the upper section of the wind shield 72 can be made from a corrosive resistant metal alloy such as stainless steel.

Flashing within the flare stack pipe 20 can create serious safety hazards. Located preferably within coupling 44 or some point within the flare stack pipe 20, is an inlet flash arrester 84 for preventing back flashing.

In typical operation, the flaring assembly is raised to a vertical position by operating winch 26 to rotate the flare stack pipe about hinge pin 18. After the flare stack pipe is raised, the waste gas supply line 23 is connected to the flare stack pipe flange 86 that is located on a 90 degree elbow 88 of the lowest section of the flare stack pipe 20. To remove the presence of liquid particles from the waste gas stream, a separator can be located upstream of the flare boom, along the waste gas supply line 23.

Once waste gas enters the flare boom, it is directed upwards in the flare stack pipe 20 to the flaring assembly 22. Upon reaching the concentric reducer 48, the waste gas velocity is increased based on the size of the opening in the concentric reducer 48.

The movement of the waste gas stream within the flaring assembly 22 causes air to also circulate within the upper and lower sections of the wind shield 72 and 74. Air enters the lower section of the wind shield 74 via the air inlet openings 33 located in the base plate 32. As the air moves upward within the lower section of the wind shield 74, it is mixed with the waste gas at the hood The air/waste gas mixture proceeds upward and exits the flare nozzle 62. The air/waste gas mixture is ignited by the flame produced from the burning of the pilot gas exiting the pilot nozzle 70. The flame resulting from the incineration of waste gas exits the upper opening of the upper section of the wind shield 72.

A means for flame detection of the type which detects ultraviolet light or heat can be utilized to maintain the flare. Should the detector 94 indicate flame extinguishment, a signal can be sent to the remote panel 96 which automatically generates a spark sent via the igniter rod 34 to relight the pilot. The remote panel 96 signals an alarm should extinguishment of the flame occur.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claims, including the full range of equivalency to which each element thereof is entitled.

What is claimed is:

1. A portable flare boom for the burning of a waste gas comprising:

a base stand;

a substantially straight rigid vertical support frame having an upper end and a lower end attached to said base stand;

a substantially straight flare stack pipe having upper and lower ends, the lower end being attached at a pivot adjacent said lower end of said vertical support frame;

a flaring assembly for flaring waste gas attached to said upper end of said flare stack pipe and having a pilot light for ignition of waste gas; and means mounted on said rigid vertical support frame for rotating said flare stack pipe about said pivot between a first vertical position wherein said flare stack pipe is contiguous to said vertical support frame and perpendicular to said base stand and a second, horizontal position.

2. A portable flare boom according to claim 1 including means for lowering said flare stack pipe comprising:

a hand operated winch mechanism secured to said vertical support frame intermediate said upper and lower ends thereof;

a pulley attached to said upper end of said vertical support frame; and a cable extending from said winch mechanism upward over said pulley and attached to said flare stack pipe.

3. A portable flare boom according to claim 1 wherein said flare stack pipe is formed by a plurality of lengths of pipes attached end to end.

4. A portable flare boom for the burning of waste gas comprising:

a base stand;

a substantially straight rigid vertical support frame having an upper end and a lower end attached to said base;

a substantially straight flare stack pipe having upper and lower ends, said lower end being pivotally supported adjacent to said lower end of said vertical support frame;

a flaring assembly for flaring waste gas attached to said upper end of said flare stack pipe and having a pilot light for ignition of waste gas;

means for sensing extinguishment of flaring waste gas;

a solar panel electrically connected to said pilot light and said means for sensing the extinguishment of flaring waste gas, the solar panel providing electrical energy to reignite said flare when extinguishment has been detected; and means mounted on said rigid vertical support frame for pivotally rotating said flare stack pipe between a first vertical position perpendicular to said base stand wherein said flare stack pipe is contiguous to said vertical support frame and a second, horizontal position.

5. A portable flare boom according to claim 4 including means for lowering said flare stack pipe comprising:

a hand operated winch mechanism secured to said vertical support frame intermediate said upper and lower ends thereof;

a pulley attached to said upper end of said vertical support frame; and a cable extending from said winch mechanism upward over said pulley and attached to said flare stack pipe.

6. A portable flare boom according to claim 4 including an alarm activated by said means for sensing extinguishment of the flaring waste gas.

7. A portable flare boom according to claim 4 wherein said flaring assembly comprises:

a base plate having a plurality of air inlet openings;

a wind shield enclosing an interior space and secured perpendicular to said base plate;

a flare stack pipe having a first and second end extending through said base plate and into the interior of said wind shield;

a concentric reducer attached to said first end of said flare stack pipe;

a hood having an upper and lower end, extending down over but spaced from said concentric reducer to facilitate the mixing of air with waste gas;

a flare nozzle;

an extension pipe attaching said upper level end of said hood to said flare nozzle;

a pilot nozzle located adjacent to said flare nozzle;

an inlet pilot gas pipe running parallel and spaced from said flare stack pipe, extending through said base plate, and attached to said pilot nozzle; and an igniter rod extending through said base plate and running parallel and spaced from said inlet pilot gas pipe, for the ignition of pilot gas at said pilot nozzle.

8. A portable flare boom according to claim 7 wherein said wind shield is a cylindrical pipe extending above said flare nozzle.

* * * * *